US009587352B2

(12) United States Patent
DeVall

(10) Patent No.: US 9,587,352 B2
(45) Date of Patent: Mar. 7, 2017

(54) TEXTILES AND PROCESS FOR MAKING TEXTILES AND DYES FROM TOBACCO PLANTS

(76) Inventor: Suzanne M. DeVall, Bainbridge, WA (US)

( * ) Notice: Subject to any disclaimer, the term of this patent is extended or adjusted under 35 U.S.C. 154(b) by 1438 days.

(21) Appl. No.: 12/783,503

(22) Filed: May 19, 2010

(65) Prior Publication Data

US 2011/0287681 A1 Nov. 24, 2011

(51) Int. Cl.
*D04H 13/00* (2006.01)
*D21H 11/12* (2006.01)
*D04H 1/4266* (2012.01)

(52) U.S. Cl.
CPC ..... *D21H 11/12* (2013.01); *D04H 1/4266* (2013.01); *Y10T 442/60* (2015.04); *Y10T 442/697* (2015.04)

(58) Field of Classification Search
CPC .... D04H 1/4266; D21H 11/12; Y10T 442/60; Y10T 442/697
USPC ..... 442/415, 416
See application file for complete search history.

(56) References Cited

U.S. PATENT DOCUMENTS 5,899,784 A 5/1999 Tri et al.
6,761,175 B2 * 7/2004 Nakanishi et al. ..... 131/354

FOREIGN PATENT DOCUMENTS

DE 10346649 A1 * 5/2005 ..... A24D 1/18
GB 871952 A * 7/1961 ..... A24B 1/30

OTHER PUBLICATIONS

Derwent English Abstract to DE 10346649 A1 to Seidel (May 12, 2005).*
Complete Textile Glossary, Celanese Acetate LLC, 2001, definition for "Textile".*
Complete Textile Glossary, Celanese Acetate LLC, 2001, definition for "Fabric".*

* cited by examiner

*Primary Examiner* — Jeremy R Pierce
(74) *Attorney, Agent, or Firm* — Richard A. Ryan

(57) ABSTRACT

A textile and a dye manufactured from fibers that are derived from tobacco plants and a process for making the textile and dye from the tobacco plants. In a preferred embodiment, the tobacco is organically grown and the entire tobacco plant, including stem and leaves, is utilized to produce the tobacco plant fiber used for making a textile and a natural dye utilized to color the textile or other textiles. One or more secondary material fibers can be mixed with the tobacco plant fiber to produce the textile. The process percolates a hot liquid solution onto tobacco plant material to cause a chemical reaction with the tobacco plant material to produce the tobacco plant fiber. Preferably, the process is a closed-loop system that minimizes the impact on the environment and utilizes less material, fuel and other resources. The dye does not require a mordant to bind with the textile.

7 Claims, 2 Drawing Sheets

TEXTILES AND PROCESS FOR MAKING TEXTILES AND DYES FROM TOBACCO PLANTS

CROSS-REFERENCE TO RELATED APPLICATIONS

None.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The present invention relates generally to textiles and processes for making textiles from plant materials. In particular, the present invention relates to textiles and processes for making textiles and dyes from tobacco plants. Even more particularly, the present invention relates to such textiles and processes that produce textiles, dyes and other useful by-products from tobacco plants in an environmentally-friendly and efficient manner.

B. Background

Plant fiber materials have been utilized for many years to produce textile from which a wide variety of fabrics can be manufactured. In particular, it has been known for many years that the bast fibers of various plants, including hemp, flax, jute, nettle, ramie and the like, can be utilized for a wide variety of different textiles. The bast fibers grow on the outside of the woody core of the plant's stalk, referred to as the xylem, and under the outer most part of the plant (e.g., the bark). These fibers give the plant strength and support the conductive cells of the phloem, the layer of the plant just under the bast fibers and in which the valuable fibers are located. The bast fibers of the typical plant are attached to the wood core fibers by the combination of pectin, a glue-like substance, and calcium ions. In order to beneficially use the bast fibers, however, they must be separated from the rest of the stalk. Typically, the separation of the bast fibers from the woody core is accomplished utilizing a procedure commonly referred to as retting, which is a process of rotting away the inner plant stalk to leave the outer bast fibers intact. Retting is accomplished by micro-organisms either on land or in the water or by using chemicals or pectinolytic enzymes.

The most common method of retting comprises placing the plant material to be retted in a pond, stream, field or tank and exposing the material to water for a sufficient amount of time to allow the water to penetrate the central stalk portion, swell the inner cells and burst the outermost layer, thereby exposing the inner core to decay-producing bacteria that will rot away the inner stalk and leave the outer fibers intact, a procedure known as decortification. As well known in the art, the retting process results in several environmental issues, primarily the production of chemical compounds that can cause pollution if the waste water is not properly treated and odors. Although pond and stream retting, which requires the plant material to be submerged in the pond or stream, tend to be the fastest methods of retting they also tend to produce the most pollution. Field retting, which involves laying the plant material out in a large field and allowing dew to collect on it, takes considerably more time but tends to produce less pollution. Tank retting typically provides greater control over the process, in which concrete vats or the like are commonly utilized as the tank, but it also produces significant toxic elements in the waste water that must be treated prior to being released to the environment. In some processes, sulphur and other toxic chemicals are introduced into the system to speed up and more effectively accomplish the process of separating the bast fibers from the wood core of the plant stalk.

As well known by those familiar with textiles (as well as many other products), there has been an increase in demand for products that are made from natural materials and for products that are produced in a more environmentally friendly or "green" manner so as to reduce negative impacts on the environment. Products which are both made from natural products and in an environmentally friendly manner are particularly desired. With regard to plants, whether utilized for their fiber or as a food source, there has been a significant increase in the demand for naturally or organically grown products. One common feature of producing such products is that they are grown with no or at least a significantly reduced amount of chemical fertilizers, pesticides and other products. Many consumers desire organically grown products because they substantially lessen the likelihood of pollutants from runoff and groundwater penetration, significantly reduce the overall "carbon footprint" by not requiring the production, delivery and application of chemicals to the land and/or plants and do not place dangerous and potentially harmful chemicals into the food chain. The use of natural plant materials for textiles has benefitted generally from the increase in the desire for natural products. Unfortunately, although the use of natural plant materials for textiles does have the benefit of being organic, including being able to be grown under organic conditions, the retting process of treating the plants to separate the desirable bast fibers for use to make the textiles is not generally considered to be organic or environmentally friendly.

One plant which has not been heretofore utilized for the production of textiles is the tobacco plant, which are plants in the genus *Nicotiana*. There are many species of tobacco plants that fall within the genus of herbs *Nicotiana*, all of which are collectively referred to as tobacco plants. Although the leaf of the tobacco plant has a long history of use in the United States and elsewhere for smoking, chewing and snuff tobacco products, it is believed that the plant fibers have never been utilized to form textiles or any textile-related products, perhaps due in part to the high value of the leaf of the plant for use in the manufacture of tobacco products. The leaves of the tobacco plant are also utilized as an organic pesticide and in some medicines. Unlike such plants as hemp and nettle, where it is primarily the stalk of the plant that is commercially beneficial (except for some use of the leaves as a tea or food item), the tobacco plant is primarily only grown for its leaves. For consumption as cigarettes and other smoking products, the tobacco plants are often fertilized with the mineral apatite to starve the plant of nitrogen and produce a more desired flavor. The mineral apatite, however, contains radium, lead and other compounds that are known to be radioactive carcinogens. After the leaves are harvested from the tobacco plant, they are cured and aged to allow for the slow oxidation and degradation of the carotenoid in the tobacco leaf. The production of tobacco plants for tobacco products are known to require the use of a relatively large amount of fertilizers and pesticides, which frequently end up in waterways and the food chain. The typical curing process requires a large amount of fuel, typically petroleum, coal and natural gas. Many areas of the world that do not have sufficient access to these fuel sources utilize a large amount of wood for the curing of the tobacco leaves, which is known to be a contributing factor to deforestation.

The use of tobacco, particularly in the form of cigarettes and other smoking products, is known to cause a variety of health issues, including cancer, that can lead to death. As a result of the health issues associated with use of tobacco products, the availability of such products is limited to persons over the age of eighteen in the United States. In addition, many government and other organizations actively and strongly encourage people to quit using such tobacco products through public service announcements and the imposition of taxes that are directed solely at tobacco products. Smoking and other uses of tobacco are banned in most public and work places. Due to the various negative health, cost, convenience and other issues related to the use of tobacco products, their use has significantly decreased over the years. This decrease in use is anticipated to continue over time. As a result, there is likely to be excess production capacity for tobacco plants that will allow its economical use as a natural textiles and other natural products. Presently, however, there is no known process for converting the otherwise harmful tobacco plant into a textile or other useful product that is efficient, economical and environmentally-friendly.

What is needed, therefore, is a process for transforming tobacco plants into textiles and other useful products. The preferred process should be adapted to being able to utilize organically grown tobacco plants and to produce textiles and other useful products from such tobacco plants in an efficient, economical and environmentally-friendly manner. Preferably, the process should be able to produce textiles which can be utilized in a variety of different fabrics and in a variety of different ways to produce woven and non-woven products. The preferred process should produce by-products that are also useful and which do not contaminate the environment and/or do not present health problems for those utilizing the process.

SUMMARY OF THE INVENTION

The textiles and process for making textiles and dyes from tobacco plants of the present invention provides the benefits and solves the problems identified above. That is to say, the present invention discloses new textiles and dyes made from tobacco plants and a process of utilizing tobacco plants to produce such textiles and dyes, as well as essential oils and other useful end products, that have not heretofore been produced from tobacco plants. The textile and process of the present invention allows and effectively encourages the use of organically raised tobacco plants. The textile is made, in whole or part, from fibers derived from tobacco plants. The process of the present invention can be utilized to transform tobacco plants into textiles, dyes, essential oils and a variety of other products in an efficient, economical and environmentally-friendly manner. The process of the present invention allows use of a plant that is primarily utilized presently to produce harmful tobacco products and encourages use of that plant for textiles, dyes, essential oils and other non-harmful products. As such, the process of the present invention will provide a significant new use for what is generally considered a plant that has an increasingly diminishing use. The process of utilizing tobacco plants of the present invention will utilize all portions of the tobacco plant.

In a primary embodiment of the present invention, the new textile comprises tobacco plant fiber that is derived from tobacco plants. In a preferred embodiment, the tobacco plants are organically grown to reduce or eliminate the use and introduction of chemicals into the environment and to reduce the amount of energy and water required to grow, harvest and process the tobacco plants. The tobacco plant fiber is manufactured to form a fabric that can be used for clothing, coverings, bags and many other uses. If desired, the tobacco plant fiber can be mixed with secondary material fibers that comprise natural fibers, such as those from animals, plants or minerals and/or synthetic fibers, such as those that are derived from petroleum or other materials, to form the textile and achieve certain desired properties for the textile. In the preferred embodiment, the tobacco plant fiber is derived from the tobacco plants by treating tobacco plant material with a heated liquid solution, preferably by percolating the solution onto the tobacco plant material. The textile can be dyed with a dye that is derived from the tobacco plants while producing the tobacco plant fiber.

The process of deriving a tobacco plant fiber from one or more tobacco plants of the present invention generally comprises the steps of obtaining tobacco plant materials from the tobacco plants and treating the tobacco plant materials in a treating system to transform the tobacco plant material into the desired tobacco plant fiber. In the preferred embodiment, the tobacco plants are organically grown and the process utilizes substantially the entire tobacco plant to produce the tobacco plant fiber. Preferably, the treating system is a closed-loop system to eliminate discharge or release of material to the environment and to reduce the amount of materials and energy needed to transform the tobacco plant materials to tobacco plant fiber. The preferred treating system percolates a hot liquid solution, comprising water, ammonia-dioxide and sulphur-dioxide, onto the tobacco plant materials and allows the tobacco plant materials to essentially stew in their own juice to breakdown the plant material into the desired tobacco plant fiber. Percolating the hot liquid solution onto the tobacco plant materials produces steam, which is condensed and directed back into the treating system. Liquid from the treating system and from dewatering the pulp produced by the treating system is utilized as a natural dye for coloring the tobacco plant based textile or other textiles.

Accordingly, the primary aspect of the present invention is to provide a tobacco plant based textile and a process for making textiles, dyes, essential oils and other products from tobacco plants that has the advantages discussed above and which overcomes the disadvantages and limitations associated with prior art uses of tobacco plants, textiles and processes for making textiles and other products.

It is an important aspect of the present invention to provide a process for making textiles, dyes, oils and other products from tobacco plants in an efficient, economical and environmentally-friendly manner.

It is also an important aspect of the present invention to provide a process for making textiles and other products that provides substantial cost and environmental benefits by facilitating and encouraging the use of organically-raised tobacco plants.

It is also an important aspect of the present invention to provide a textile that is comprised of fibers derived from tobacco plants.

It is also an important aspect of the present invention to provide a textile that comprises tobacco plant fibers and fibers from one or more secondary fiber materials, such as natural fibers from an animal, plant or mineral or synthetic fibers from nylon, polyester, acrylic or the like.

Another important aspect of the present invention is to provide a fabric which is comprised essentially of fibers derived from tobacco plants, preferably with such plants being grown organically.

Yet another important aspect of the present invention is to provide a process that comprises a substantially closed-loop system that utilizes a heated liquid solution to break down tobacco plants to provide tobacco plant fibers that can be utilized to form a textile and liquid that can be utilized as a dye.

The above and other aspects and advantages of the present invention are explained in greater detail by reference to the attached figures and the description of the preferred embodiment which follows. As set forth herein, the present invention resides in the novel features of form, construction, mode of operation and combination of the above presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed text and drawings are merely illustrative of one or more preferred embodiments and, as such, disclose one or more different ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the figures and description provided herein show certain steps and compounds for the process of producing fiber and dye from tobacco plants, those skilled in the art will readily understand that this is merely for purposes of simplifying this disclosure and that the present invention is not so limited.

Figure 1:
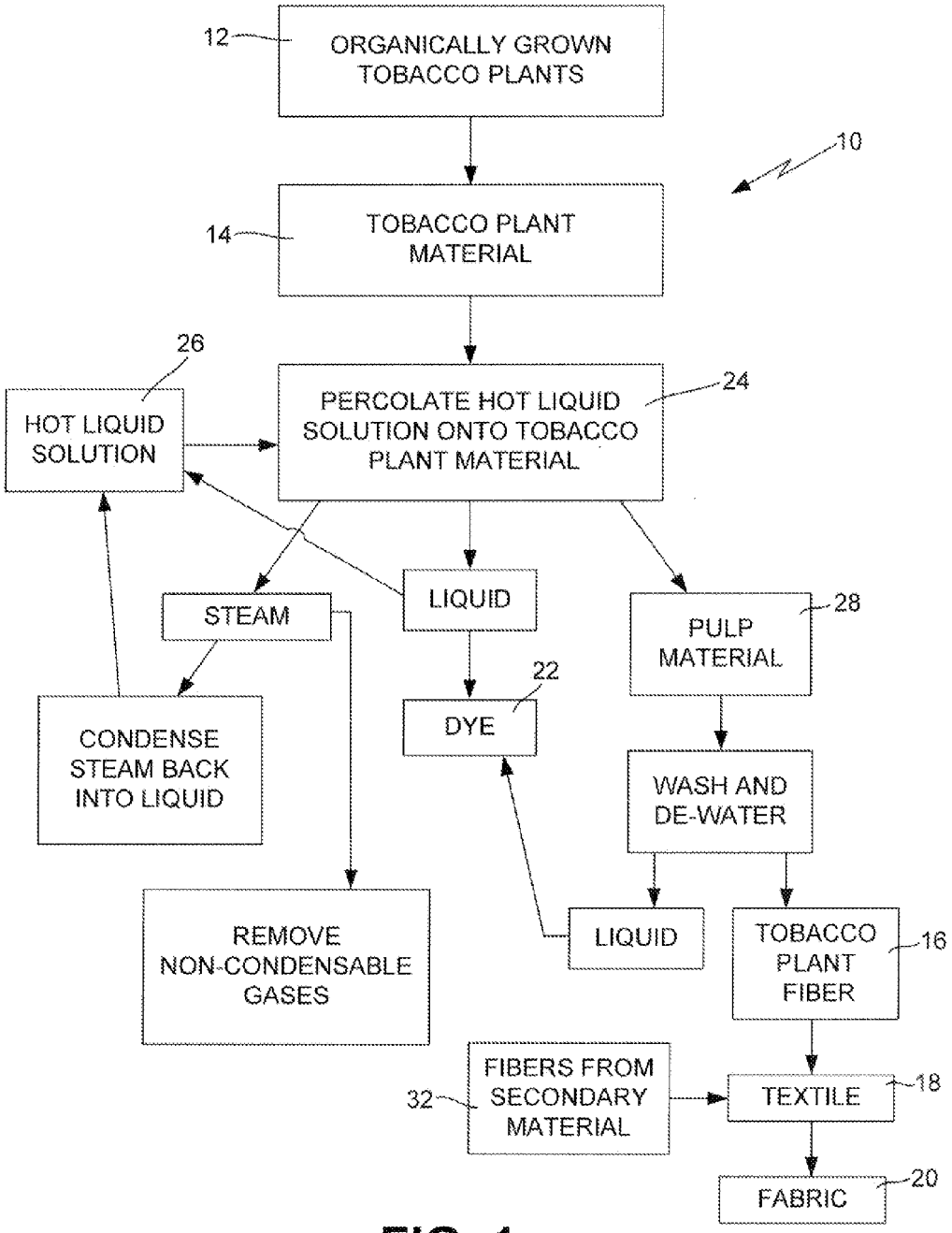
FIG. 1 is a chart summarizing the overall process of deriving a textile and dye from tobacco plants configured according to a preferred embodiment of the present invention.
Figure 2:
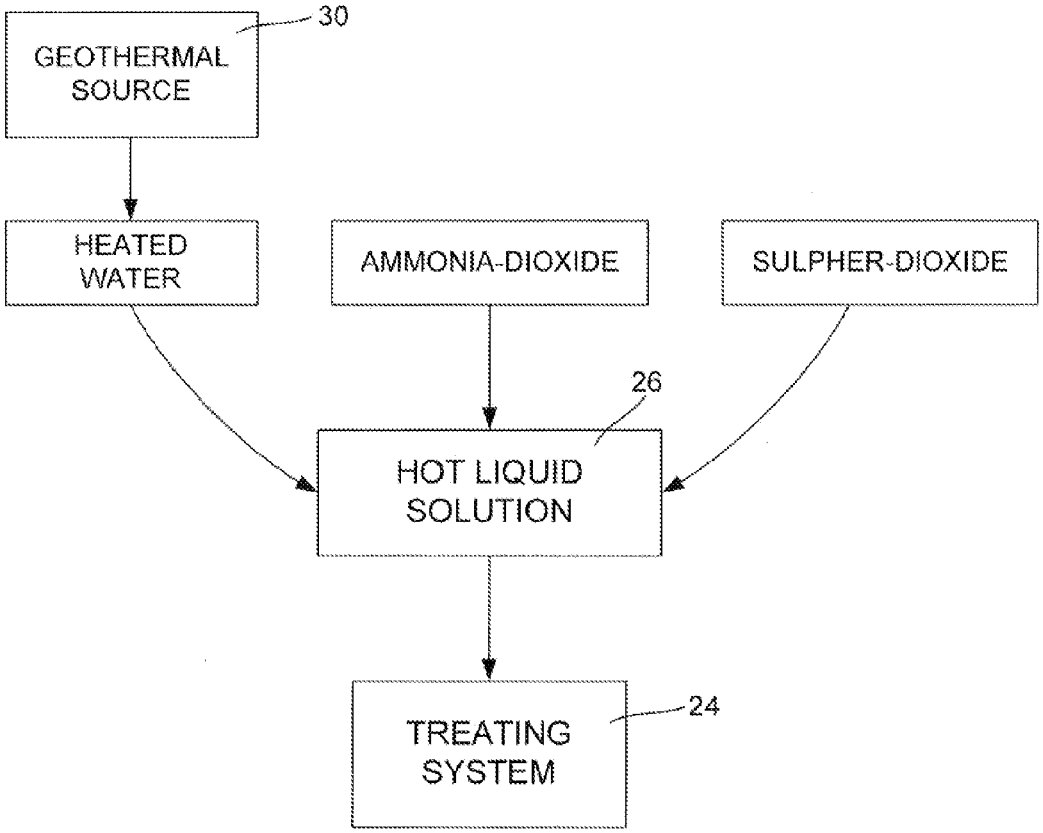
FIG. 2 is a chart summarizing the hot liquid solution utilized in the process summarized in FIG. 1 to produce tobacco plant fibers and a natural dye from tobacco plants.

A process for producing textile and dye from tobacco plants that is configured pursuant to a preferred embodiment of the present invention is shown generally as 10 in the figures. As set forth in more detail below and summarized in FIG. 1, the process 10 of the present invention preferably utilizes organically grown tobacco plants 12 to provide the tobacco plant material 14 which is treated to produce tobacco plant fibers 16 that are utilized to form a textile 18 which is processed to form a fabric 20 that can be used to make clothing, handbags, bags, rope, covers, bedding and a wide variety of other materials that are commonly made from textiles that have natural and/or synthetic fibers. In the preferred embodiment, the process 10 of the present invention also produces a natural dye 22 and other useful by-products from the tobacco plants 12. Although tobacco plants 12 grown according to currently available, non-organic methods can be utilized in the process 10 of the present invention, organically grown tobacco plants 12 are preferred due to the fact that such tobacco plants 12 do not require the use of chemicals which are typically considered to be potentially harmful to the environment. As shown in FIGS. 1 and 2, the preferred process 10 of treating the tobacco plants 12 does not introduce any harmful chemical wastes into the environment and is configured as a closed-loop system that substantially reuses all of the materials produced by the process 10 that is not selected as an end product (e.g., the textile 18 and dye 22). The process 10 of the present invention preserves the beneficial features of the tobacco plants 12 to produce tobacco plant fibers 16 that are utilized in a unique textile 18 which can produce fabrics 20 of exceptional value.

The process 10 of the present invention utilizes a procedure the inventor refers to as "bio-degumming" which takes advantage of the unique properties of the various varieties of tobacco plants 12 to breakdown the fibers 16 thereof in an environmentally non-impact manner that results in little damage to the fibers 16 produced by the process 10. The bio-degumming of the present process 10 does not utilize or result in the harmful chemicals and other waste products that are typically used or associated with breaking down the pectin during the standard decortification procedure used to separate the bast fibers from the woody core of plants. In addition, the process 10 of the present invention includes a method of bio-digestion that uses the whole plant, including the stem and leaves, in an anaerobe environment to breakdown all elements of the fiber, stem and leaf into the desired useful fibers 12 and dye 22. When the bio-digestion is stopped at the correct time, which is likely to vary with different varieties of tobacco plants 12, the tobacco leaves, stems and waste fiber are in the desired condition, without loss of strength and feeling brittle (which can occur with other processes and/or plants). In addition to not requiring any additional chemicals, enzymes or other auxiliary materials, the process 10 of the present invention does not compromise the natural color, aroma and fragrance of the tobacco plants 12, which are then beneficially utilized in the textiles 18 and fabrics 20 produced by process 10. The natural liquor produced by the non-invasive process 10 of the present invention allows the tobacco plant fiber 16 and dye 22 to be unique for processing into the desired textile 18.

As stated above, in the preferred embodiment the process 10 of the present invention utilizes organically grown tobacco plants 12 as the source of the plant materials 14 that is converted to the textile 18, dye 22 and any other products. Organically grown tobacco plants 12 for use with the process 10 can produce abundant crops, including leaf and stem fiber, with no pesticides, herbicides or defoliants due to the fact that the tobacco plants 12 will be grown for the dedicated purpose of being utilized by the process 10 to produce textiles 18 and dyes 22 instead of being grown for the normal smoking, chewing and like tobacco products. One benefit of utilizing tobacco plants 12 for fiber instead of wood chips is that the stem, leaves and other plant material of the tobacco plant 12 has twice as much cellulose and fiber per unit weight. One benefit of utilizing organically grown tobacco plants 12 is that the use of tobacco plant fibers 16 would be an environmentally-friendly alternative to synthetic petroleum-based fibers and wood pulp. Overall, the process 10 would benefit human health and the environment and lower the usage of water and energy.

Although a wide variety of tobacco plant varieties may be utilized for the process 10 of the present invention, the Burley, Va., Oriental and Basma varieties are believed to be most suited for being grown organically, e.g. with no herbicides, pesticides or other chemicals, for the process 10. Preferably, only natural insects would be used to control pests. Because the process 10 of the present invention utilizes the entire tobacco plant 12, including stems and leaves, the process 10 effectively allows the entire tobacco plant 12 to be biodegradable. Other benefits of the process 10, particularly with regard to facilitating the use of organically grown tobacco plants, is that it will result in higher overall yield, lower production costs, lower capital costs and far less pollution, energy consumption and water usage. Because the tobacco is not cured for the process 10 of the present invention, there will be a further reduction in energy usage and much less need for wood, thereby reducing the impact on the environment, particularly the soil and air. Presently, it is believed there is very little, if any, tobacco plants 12 that are grown in an organic, environmentally-friendly manner.

As stated above, preferably the process 10 of the present invention is configured to be a closed-loop system, as best shown in FIG. 1. Because the tobacco plants 12 are more plant-like than tree fiber, toxic chemicals are not required to break down the tobacco plant 12 into a pulp or fiber-like pulp that can be utilized to form the tobacco plant fibers 16 for the textile 18 of the present invention. Instead, the process 10 of the present invention utilizes the natural chemicals in the tobacco plant 12 to break down the tobacco plant material 14 to obtain the desired fibers 16. Basically, as set forth below, the tobacco plant materials 14 stew in their own juice for a sufficient amount of time, which is likely to depend on the variety of tobacco plant 12, to produce the tobacco plant fibers 16. Although individual components of the tobacco plant 12 can be utilized in the process 10 of the present invention, the preferred configuration of the process 10 utilizes the entire tobacco plant 12 to increase fiber product, improve efficiency and reduce waste. As also stated above, the process 10 of the present invention is believed to be applicable to all varieties of tobacco plants 12. In addition to providing tobacco plant fiber 16 that is used for textiles 18, which can be made into a variety of fabrics 20, the process 10 of the present invention also produces a natural dye 22, as shown in FIG. 1, that can be utilized with the tobacco plant-derived textile 18 (or the textile 18 can be the natural color of the tobacco plant fiber 16) and with other textiles. As set forth in more detail below, the dye 22 produced by the process 10 is permanent, is more resistant to fading and does not require a mordant to stabilize the dye and bond it to the textile 18 or any other textile.

The process 10 of the present invention, best summarized in FIG. 1, preferably comprises a treating system 24 that applies a heated liquid solution 26 to the tobacco plant material 14 to interact with the plant materials 14 so they will stew in their own juices and break down the plant materials 14 into the tobacco plant fiber 16 and dye 22. Preferably, the treating system 24 is a closed-loop system. Water in the closed-loop treating system 24 will be reused to treat the plant material 14 or used to produce the dye 22. The tobacco plants 12, which are preferably organically grown, are harvested to obtain the tobacco plant materials 14 that will be utilized in the process 10 of the present invention. In contrast to normal tobacco harvesting, the entire tobacco plant 12 is harvested from the field, significantly simplifying the harvesting process. In fact, under certain circumstances, it may be beneficial to harvest the tobacco plants 12 by hand instead of utilizing machinery to reduce fuel consumption and the pollution that is associated with mechanical harvesting. Once harvested, the tobacco plant materials 14 are placed inside the closed-loop treating system 24 and a hot liquid solution 26 is applied to these tobacco plant materials 14. In one embodiment, the ratio of hot liquid solution 26 to tobacco plant materials 14 is approximately 4.5% by weight, with the hot liquid solution 26 at a temperature of approximately 170° F. and applied for approximately 180 minutes, as necessary to sufficiently soften the tobacco plant materials 14. Some varieties of tobacco plants 12, may require a higher or lower liquid temperature and/or a shorter or longer exposure time period. Typically, the hot liquid solution 26 will break down the tobacco plant materials 14 and result in a breakdown of approximately 55% of the weight of the tobacco plant materials 14, which is approximately 12.8% to 17% higher material remaining than wood pulp or linen.

The application of the hot liquid solution 26 to the tobacco plant material 14 produces steam that significantly aids in the necessary breakdown of the tobacco plant material 14. The steam also sets the dye liquor of dye 22 as a permanent solution that does not require the use of heavy metals or salts. In the preferred embodiment, the hot liquid solution 26 is achieved by heating water in an environmentally-friendly manner, such as using a geothermal source 28 (as shown in FIG. 2), solar energy or other such sources. As also shown in FIG. 2, in a preferred embodiment, the hot liquid solution 26 comprises heated water, ammonia-dioxide and sulphur-dioxide, which are mixed into solution and applied to the tobacco plant material 14 in the treating system 24. Experimentation by the inventor has found that this combination creates a chemical reaction with the tobacco plant material 14 that beneficially breaks down the tobacco plant material 14 into the desired pulp material 30, which is then used to make tobacco plant fiber 16, and produces a high quality, useful dye 22 without creating the various environmental issues associated with other fiber processes. The water used in the hot liquid solution 26 should be clean and not contain any chemicals, such as chlorine or the like.

In the preferred embodiment, the hot liquid solution 26 is applied to the tobacco plant material 14 utilizing a drip percolation process, which has been found to sufficiently soften the tobacco plant material 14, including the leaves, into the desired tobacco plant fiber 16. The application of the percolating hot liquid solution 26 onto the tobacco plant material 14 that converts the material 14 to fiber 16 produces steam. For use as a textile 18, the pulp material 30 is removed while still in a fibrous stage. In contrast, for use to make paper, the pulp is as soft (e.g., near-liquid form) as possible to produce the desired thin fiber. In the present invention, the pulp material is then washed and dewatered to produce the tobacco plant fiber 16 that is used to form the textile 18. The textile is then processed into the desired fabric 20 by spinning, weaving, knitting, crocheting, bonding, pressing or by other known processes or combinations thereof as applicable for the fabric 20. Among other products, the textile 18 can be utilized to form yarn, thread, fleece or the like. As shown in FIG. 1, the steam that is produced in treating system 24 is condensed back into liquid and directed back into the hot liquid solution 26 and any non-condensable gases are dissipated. By recycling and reusing materials and utilizing the entire tobacco plant, the closed, integrated environment of the treating system 24 reduces or substantially eliminates any pollution from the process 10 of the present invention.

The fiber 16 produced by the process 10 of the present invention has been found by the present inventor to have an innate aroma that impregnates the fiber 16 and a fragrance that fully penetrates the fiber 16, which is in contrast to other natural and synthetic fibers. The fragrance, which smells good, is subtle, yet somewhat complex. In addition, further contrasting with other fiber materials, the fragrance is retained by the fiber 16 of the present invention for a very long time and has been found to, in effect, regenerate itself with mild washing. The oils produced in the process 10 and imbedded in the fibers 16 naturally softens the fabric 20, significantly reducing the need for other chemical products to soften the clothes or other items made from fabric 20. The resulting fiber 16 is strong, yet soft and rather luxurious with a natural uncompromising sheen. The fiber 16 looks and feels like fine silk, yet it can be spun into bulky yarn for outerwear used with outdoor fabrics. The colors created of the fabric 20 resulting from fiber 16 produced by the process 10 is a natural, unique color that is saturated into the fiber 16 and lasts through many washings, making the fabric 20 highly valuable without compromising the fiber 16.

As also summarized in FIG. 1, some of the excess liquid that is applied to the tobacco plant material 14 in the treating system 24 is returned in the process 10 to be reused in the hot liquid solution 26. The remaining portion of the liquid, particularly that which is removed during the de-watering of the pulp material 28 is utilized for the dye 22. In effect, the process 10 of the present invention creates its own dye 22 that can be utilized to dye the textile 18 which is produced from the tobacco plant fiber 16 and/or other textiles. One particular advantage of the dye 22 produced by process 10 is that it does not require a chemical mordant to saturate the textile 18 or other textiles. Instead, the dye 22 permanently attaches itself to a textile, including textile 18, to effectively become part of the textile 18, as opposed to other dyes that do not attach themselves to the fibers and, therefore, require a mordant to dye the textile 18. This feature, which is unique to tobacco plants 12, substantially allows full utilization of as much of the tobacco plant 12 as possible in a single process, namely the process 10 of the present invention. The elimination of the need for the mordant to set the dye reduces the requirement for additional chemicals and, as such, provides a number of environmental benefits.

As stated above, the dye 22 that is produced by the process 10 of the present invention can be utilized to color the textile 18 produced from the tobacco plant fiber 16, other textiles and/or blends of the textile 18 and other textiles. For purposes of the present invention, the fibers that are utilized to produce other textiles are referred to as secondary material fibers 32, as shown in FIG. 1. Secondary material fibers 32 may be natural fibers, such as those obtained from animal, plant or mineral sources (including wool and cotton), and synthetic fibers, such as nylon, polyester, acrylic and the like, or a combination of natural and synthetic fibers. The availability, desirability and beneficial uses of the various secondary material fibers 32 are generally well known in the art. As shown in FIG. 1, the secondary material fibers 32 can be mixed with the tobacco plant fiber 16 to produce the desired textile 18 having properties of the combined fiber. The dye 22 produced by the process 10 has a wide range of available color hues, estimated to be 50 or more color hues, ranging from pale to intense colors. The color of the dye 22 is primarily affected by the variety of tobacco plant 12 and the stage of growth the tobacco plant 12 is at when it is harvested.

The uses for the fiber 16, textile 18 and dye 22 made from tobacco plants 12 are virtually unlimited. The ability of the fiber 16 derived from the process 10 of the present invention to be utilized for a wide variety of different products will create a new market for tobacco plants 12 and encourage the tobacco plants 12 to be organically grown, providing a new, environmentally-friendly use for a plant that is now considered by many to be toxic and not beneficial to society. The process 10 of the present invention could be utilized to support a completely sustainable economy from the farm to the factory, which will be beneficial for local employment, while leaving a very small "footprint" on the region or regions where the tobacco plants 12 are growing and being processed into fiber 16. Unlike the presently available means of producing fiber, the process of the present invention produces fiber 16 by utilizing virtually the entire tobacco plant 12 without the use of toxic chemicals that are discharged to or disposed in the environment.

While there are shown and described herein one or more specific embodiments of the invention, it will be readily apparent to those skilled in the art that the invention is not so limited, but is susceptible to various modifications and rearrangements in design and materials without departing from the spirit and scope of the invention. In particular, it should be noted that the present invention is subject to various modifications with regard to any dimensional relationships set forth herein, with regard to its assembly, size, shape and use and with regard to the materials used in its construction. For instance, there are a number of components described herein that can be replaced with equivalent functioning components to accomplish the objectives of the present invention.

What is claimed is:

1. A textile, comprising a tobacco plant fiber derived from a tobacco plant, wherein said textile comprises said tobacco plant fiber mixed with one or more secondary material fibers, said secondary fibers comprising at least one of a natural fiber and a synthetic fiber.

2. The textile of claim 1, wherein said tobacco plant is at least substantially organically grown.

3. The textile of claim 1, wherein said tobacco plant fiber is manufactured to form a fabric.

4. A textile, comprising a tobacco plant fiber derived from a tobacco plant, wherein said tobacco plant fiber is derived from said tobacco plant by treating a tobacco plant material with a liquid solution.

5. The textile of claim 4, wherein said tobacco plant fiber is colored with a dye produced from said tobacco plant while producing said tobacco plant fiber.

6. A fabric, comprising a textile consisting essentially of a tobacco plant fiber derived from a tobacco plant, wherein said textile comprises said tobacco plant fiber mixed with one or more secondary material fibers, said secondary fibers comprising at least one of a natural fiber and a synthetic fiber.

7. The fabric of claim 6, wherein said tobacco plant is at least substantially organically grown.

* * * * *